US010739707B2

(12) United States Patent
Takematsu et al.

(10) Patent No.: US 10,739,707 B2
(45) Date of Patent: Aug. 11, 2020

(54) ENDLESS BELT WITH LUBRICANT ON INNER SURFACE AND IMAGE FIXING DEVICE

(71) Applicant: CANON KABUSHIKI KAISHA, Tokyo (JP)

(72) Inventors: Koji Takematsu, Abiko (JP); Makoto Tanaka, Kashiwa (JP); Satoshi Ishikawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/587,304

(22) Filed: Sep. 30, 2019

(65) Prior Publication Data

US 2020/0103793 A1 Apr. 2, 2020

(30) Foreign Application Priority Data

Oct. 1, 2018 (JP) ..... 2018-186878

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2053; G03G 2215/2016
USPC ..... 399/325, 329, 333
See application file for complete search history.

(56) References Cited

U.S. PATENT DOCUMENTS 8,781,364 B2 * 7/2014 Fukuda et al. ..... G03G 15/2053 399/329
9,256,174 B2 2/2016 Yamamoto
10,527,987 B1 * 1/2020 Kawaguchi ..... G03G 15/2025

FOREIGN PATENT DOCUMENTS

JP 2015-165281 A 9/2015

* cited by examiner

*Primary Examiner* — William J Royer
(74) *Attorney, Agent, or Firm* — Venable LLP

(57) ABSTRACT

A replacement endless belt for an image heating device for heating an image on a recording material includes an endless base layer; a parting layer provided on an outer peripheral surface of the base layer; and a lubricant applied on at least a circumferentially partial area of an inner surface, except for predetermined regions from opposite ends of the endless belt.

9 Claims, 8 Drawing Sheets

(a) ROTATIONAL DIRECTION (b) RECIPROCATION

ENDLESS BELT WITH LUBRICANT ON INNER SURFACE AND IMAGE FIXING DEVICE

FIELD OF THE INVENTION AND RELATED ART

The present invention relates to an endless belt which is employable by an image fixing device. It relates also to a fixing device equipped with an endless belt.

Generally speaking, a fixing device fixes an unfixed toner image on a sheet of recording medium by heating the combination of the unfixed toner image and sheet of recording medium while pressing the combination. There have been known fixing devices structured to employ an endless belt as a fixation belt. In the case of a fixing device structured to employ a fixing belt, its fixation belt and rotational member are placed in contact with each other to form a heating nip for heating a sheet of recording medium and the toner image thereon while pressing them. Further, it is provided with a belt-backing member which is for forming the heating nip by backing the fixation belt as the rotational member presses on the fixation belt inward of the fixation belt, and on which the fixation belt slides by its inward surface. There has also been proposed to apply lubricant such as grease, to a part of the inward surface of the fixation belt, which extends from one edge of the belt to the other in terms of the widthwise direction of the belt, but, only partially extends in terms of the circumferential direction, to reduce the friction between the fixation belt and belt-backing member (Japanese Laid-open Patent application No. 2015-165281).

However, a fixing device such as the one disclosed in Japanese Laid-open Patent Application No. 2015-165281, the inward surface of the fixation belt of which is coated with lubricant, across an area which extends one end of the belt to the other in terms of the widthwise direction of the belt, but, only partially in terms of the circumferential direction of the belt, suffers from the following problems. First, the edges of the fixation belt are likely to come into contact with a packaging material for wrapping the belt, making it possible that the packaging material will be soiled by the lubricant, and then, the lubricant will transfer from the packaging material to the outward surface of the belt. Further, it is possible that during the process of attaching a fixation belt to a fixing device, lubricant will transfer from the edges of the belt onto the hand(s) of an operator, and then, onto the outward surface of the belt, possibly leaving finger prints on the outward surface of the belt. If lubricant adheres to the outward surface of the fixation belt, it is possible that an image forming apparatus will output defective images.

SUMMARY OF THE INVENTION

Thus, the primary object of the present invention is to provide an endless belt which can make it unlikely to occur that when an endless belt coated with lubricant across its inward surface is replaced, the lubricant on the inward surface of the belt transfers onto the outward surface of the belt.

According to an aspect of the present invention, there is provided a replacement endless belt for an image heating apparatus for heating an image on a recording material, said endless belt comprising an endless base layer; a parting layer provided on an outer peripheral surface of said base layer; and a lubricant applied on at least a circumferentially partial area of the inner surface, except for predetermined regions from opposite ends of said endless belt.

Further features of the present invention will become apparent from the following description of exemplary embodiments with reference to the attached drawings.

Figure 6:
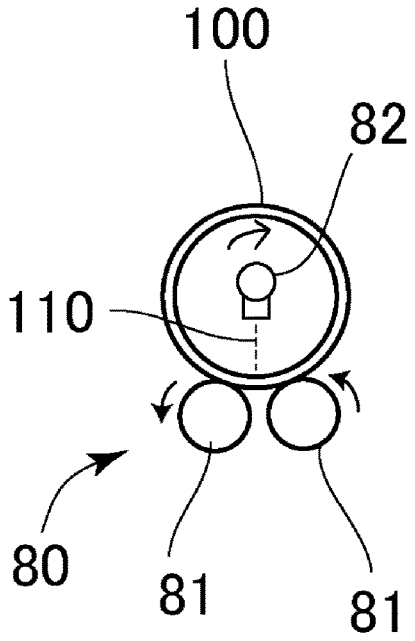
Figure 6:
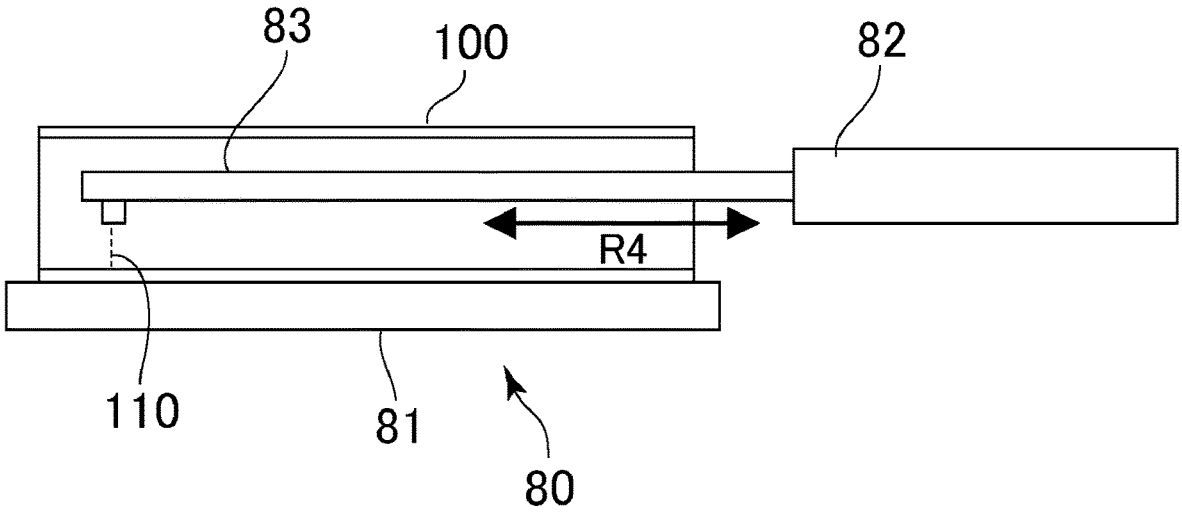

Parts (a) and (b) of FIG. 6 are a combination of a schematic sectional view of a lubricant applying apparatus in the first embodiment, as seen from the direction which is parallel to the rotational axis of the fixation belt, and a sectional view of the lubricant applying apparatus at a plane which coincides with the rotational axis of the fixation belt.

Figure 7:
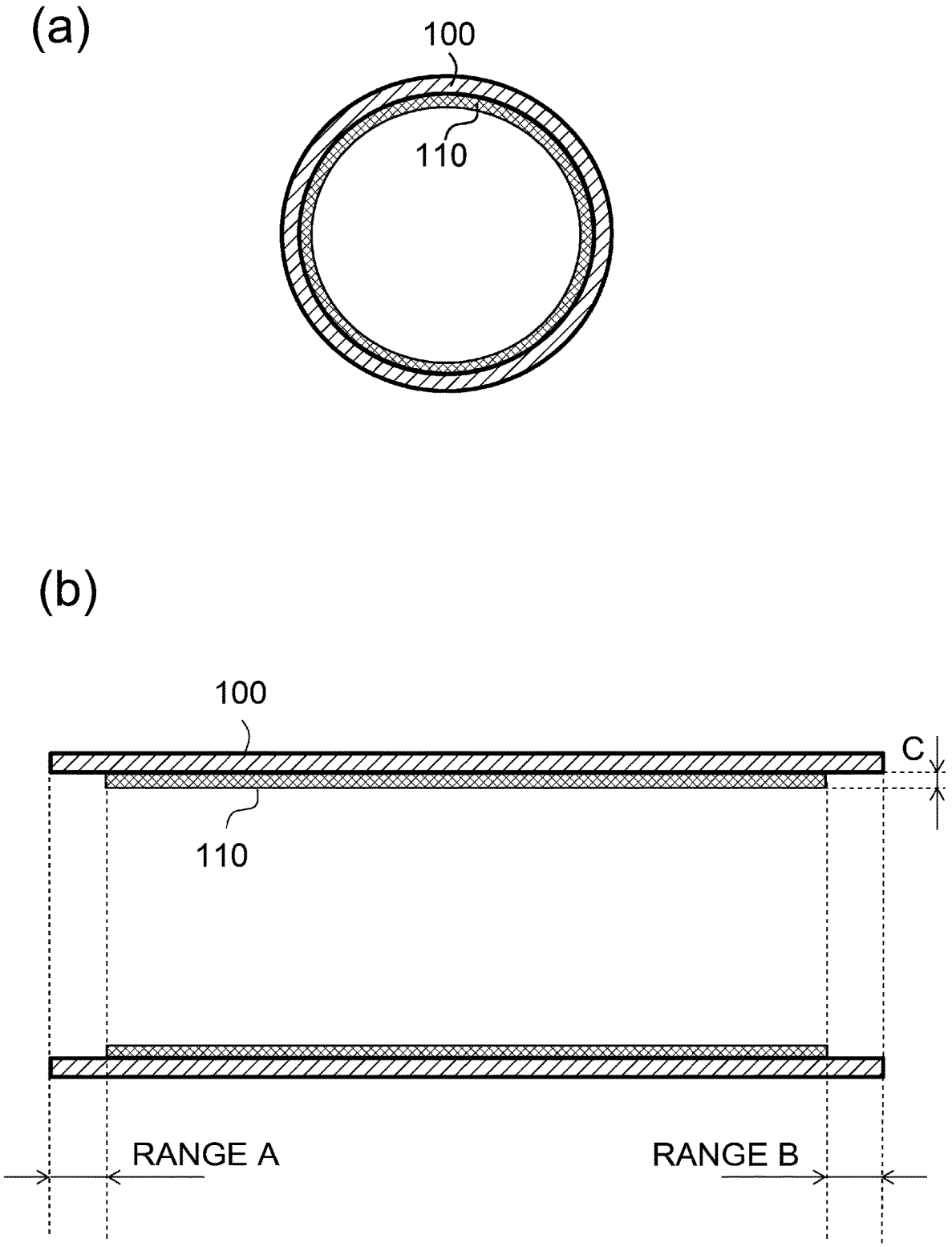

Parts (a) and (b) of FIG. 7 are a combination of a schematic sectional view of the fixation belt in the first embodiment at a plane which is perpendicular to the rotational axis of the fixation belt, and a schematic sectional view of the fixation belt at a plane which is parallel to the rotational axis of the belt, and which coincides with the rotational axis of the belt.

Figure 8:
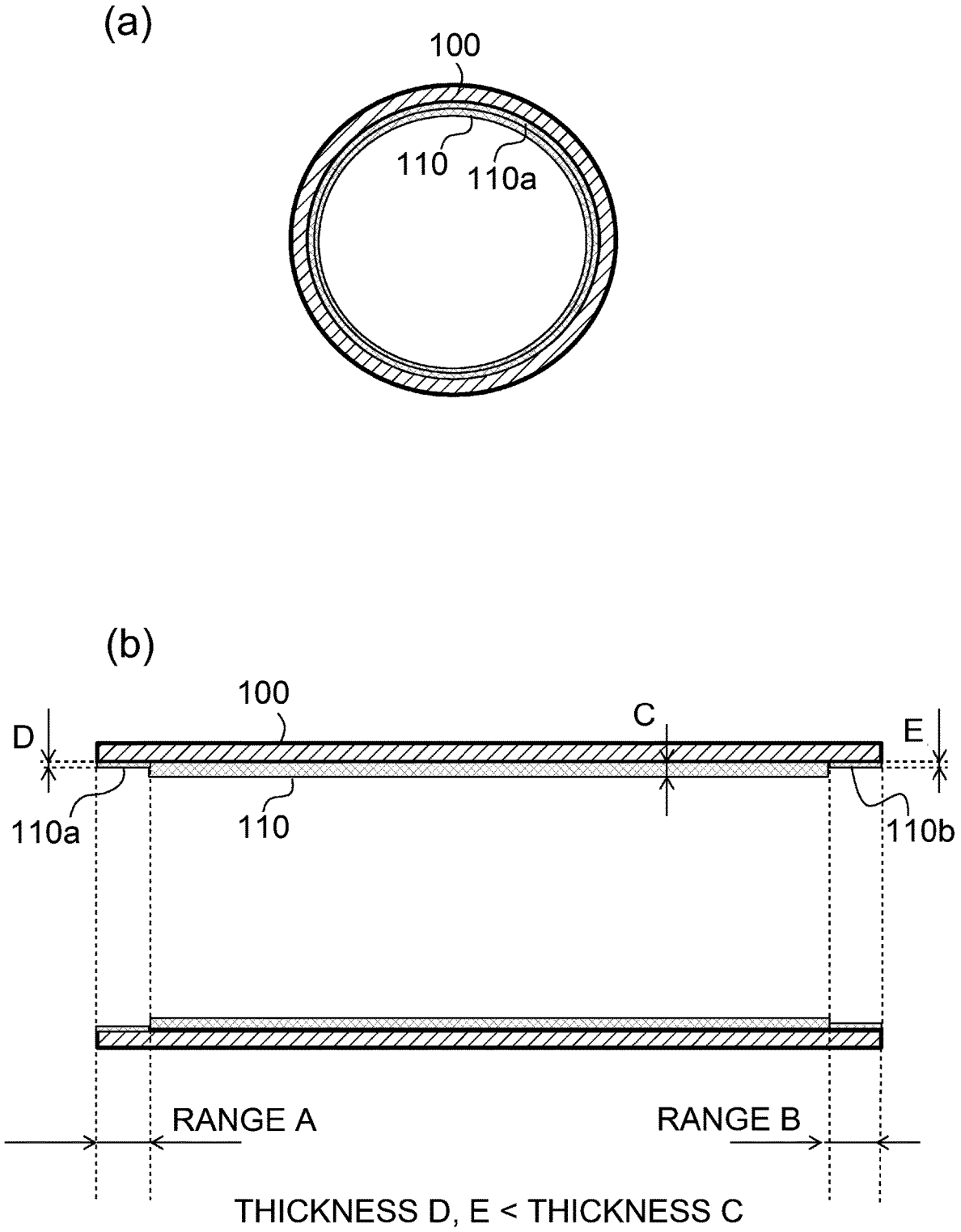

Parts (a) and (b) of FIG. 8 are a combination of a schematic sectional view of a fixation belt in a second embodiment of the present invention at a plane which is perpendicular to the rotational axis of the fixation belt, and a schematic sectional view of the fixation belt at a plane which is parallel to the rotational axis of the belt, and which coincides with the rotational axis of the belt.

Figure 9:
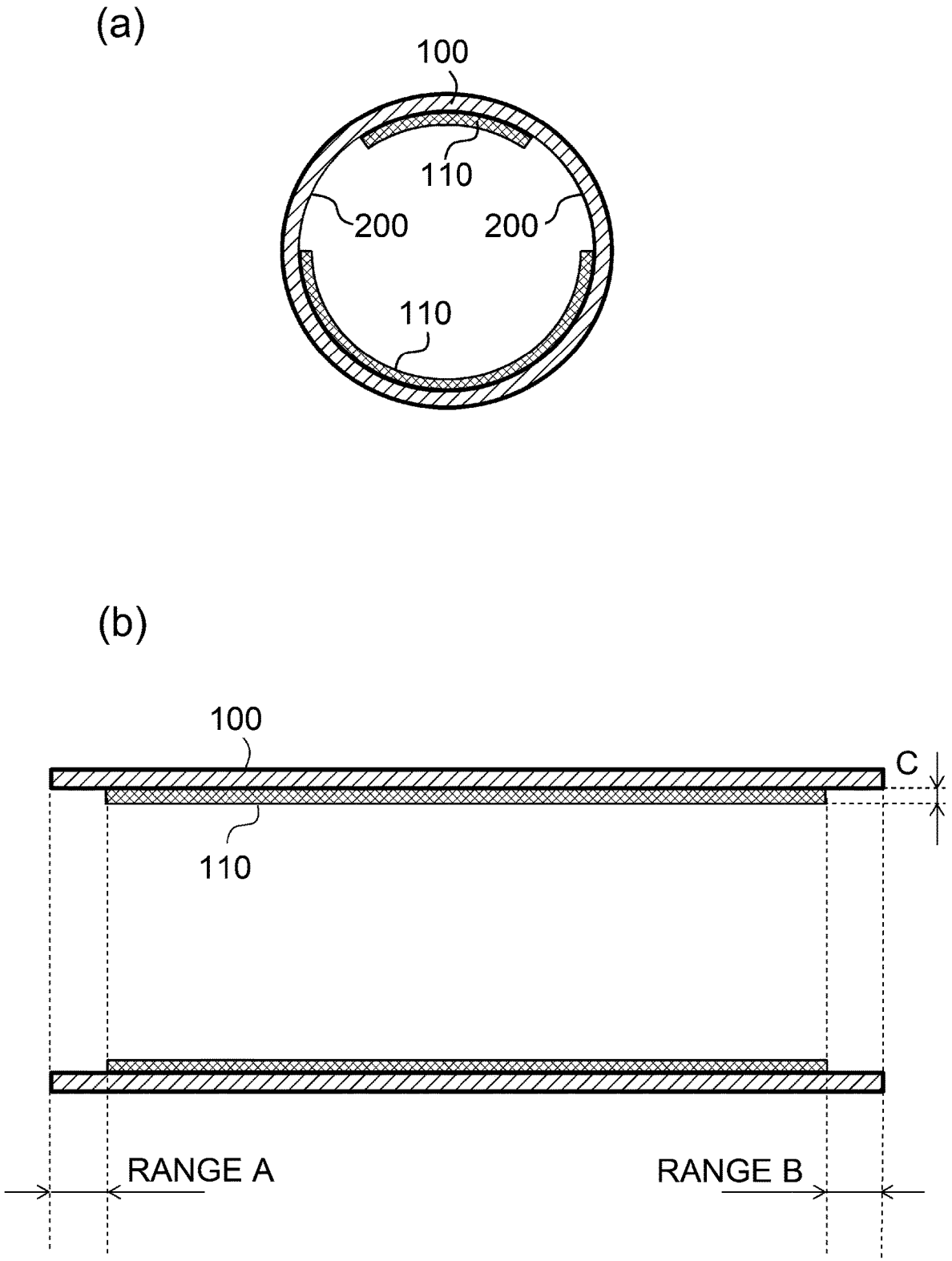

Parts (a) and (b) of FIG. 9 are a combination of a schematic sectional view of a fixation belt in another embodiment of the present invention at a plane which is perpendicular to the rotational axis of the fixation belt, and a schematic sectional view of the fixation belt at a plane which is parallel to the rotational axis of the belt, and which coincide with the rotational axis of the belt.

DESCRIPTION OF THE EMBODIMENTS

Embodiment 1

To begin with, referring to FIGS. 1-7, the first embodiment of the present invention is described. First, referring to FIG. 1, an image forming apparatus 1 in this embodiment is described about its general structure.

[Image Forming Apparatus]

Figure 1:
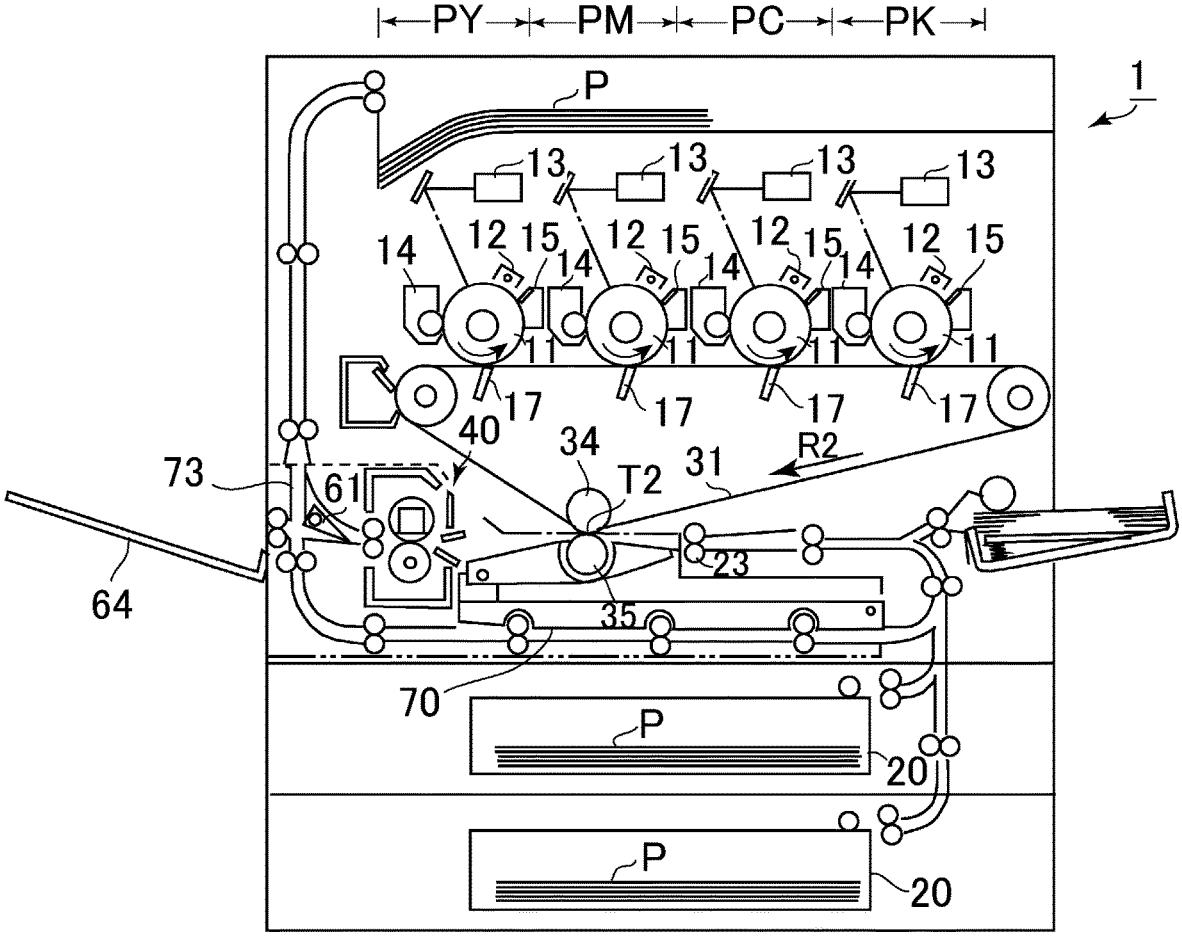
FIG. 1 is a schematic sectional view of an image forming apparatus in a first embodiment of the present invention; it shows the general structure of the apparatus.

Referring to FIG. 1, the image forming apparatus 1 is a full-color printer of the so-called tandem type. It has yellow, magenta, cyan and black image forming portions PY, PM, PC and PK, respectively, which are aligned in tandem in the listed order along an intermediary transfer belt 31.

In the image forming portion PY, a yellow toner image is formed on a photosensitive drum 11(Y), and is transferred onto the intermediary transfer belt 31. In the image forming portion PM, a magenta toner image is formed on a photosensitive drum 11(M), and is transferred onto the intermediary transfer belt 31. In the image forming portions PC and PK, a cyan toner image and a black toner image are formed on photosensitive drums 11(C) and 11(K), respectively, and are sequentially transferred onto the intermediary transfer belt 31.

The image forming portions PY, PM, PC and PK are practically the same in structure, although they are different in the color of the toner used by their developing apparatus; they use yellow, magenta, cyan, and black toners, respectively. Hereinafter, therefore, the image forming portions are described with reference to the yellow image forming portion PY; the other image forming portions PM, PC and PK are not described.

The image forming portion PY is provided with the photosensitive drum 11, which is a cylindrical photosensitive member as an image bearing member. The photosensitive drum 11 is rotationally driven in the direction indicated by an arrow mark in the drawing. The image forming portion PY is also provided with a corona-based charging device 12, an exposing apparatus 13, a developing apparatus 14, a transfer blade 17, and a drum cleaning apparatus 15, which are disposed in the listed order in the adjacencies of the peripheral surface of the photosensitive drum 11. The corona-based charging device 12 is a charging means. It uniformly charges the peripheral surface of the photosensitive drum 11 to a preset potential level. The exposing apparatus 13 writes an electrostatic image on the peripheral surface of the photosensitive drum 11 by scanning the uniformly charged peripheral surface of the photosensitive drum 11 with a beam of laser light it outputs. The developing apparatus 14 develops the electrostatic image on the peripheral surface of the photosensitive drum 11 into a toner image. The transfer blade 17 transfers the toner image on the photosensitive drum 11 onto the intermediary transfer belt 31 by being provided with voltage. The drum cleaning apparatus 15 cleans the peripheral surface of the photosensitive drum 11 after the transfer of the toner image.

The intermediary transfer belt 31 is an intermediary transferring member. It is suspended and tensioned by multiple rollers, such as a secondary transfer internal roller 34. It is circularly moved in the direction indicated by an arrow mark R2 in the drawing. The image forming apparatus 1 is also provided with a secondary transfer outside roller 35, which is positioned so that it opposes the secondary transfer inward roller 34, with the presence of the intermediary transfer belt 31 between itself and the secondary transfer inside roller 34, and also, so that the secondary transferring portion T2, which is for transferring the toner image on the intermediary transfer belt 31, onto a sheet P of recording medium, forms a secondary transferring portion T2 between itself and the intermediary transfer belt 31. Further, the image forming apparatus 1 is provided with a fixing device 40, which is positioned on the downstream side of the secondary transferring portion T2 in terms of the recording medium conveyance direction.

Sheets P of recording medium are moved out one by one from a recording medium cassette 20. Then, each sheet P is conveyed to a pair of registration rollers 23, and is kept on standby by the registration rollers 23. Then, each sheet P of recording medium is conveyed to the secondary transferring portion T2 by the pair of registration rollers 23 with such timing that it arrives at the secondary transferring portion T2 at the same time as the toner image on the intermediary transfer belt 31. In the secondary transferring portion T2, the toner image is transferred (secondary transfer) from the intermediary transfer belt 31 onto the sheet P of recording medium. After the transfer (secondary transfer) of the four toner images, which are different in color, onto the sheet P, the sheet P is conveyed to the fixing device 40, in which the sheet P and the toner images thereon are heated, while being pressed, to fix the toner images to the sheet P. Then, the sheet P is discharged into an external tray 64.

On the other hand, in a case where it is necessary to form an image on both surfaces of a sheet P of recording medium, the sheet P is guided upward by a switching member 61 after the fixation of a toner image on one of the two surfaces of the sheet P. Then, the sheet P is changed in its moving direction (switched back), in a sheet conveyance passage 73, being thereby flipped upside down. Then, it is conveyed though a two-sided printing passage 70, and is conveyed to the pair of registration rollers 23, by which it is kept on standby. Then, a toner image is transferred on the other surface of the sheet P in the secondary transferring portion T2, and is fixed to the sheet P by the fixing device 40. Then, the sheet P is discharged into the external tray 64. By the way, as for the types of recording medium, a sheet of ordinary paper, plastic film, fabric, or the like may be listed.

[Fixing Device]

Figure 2:
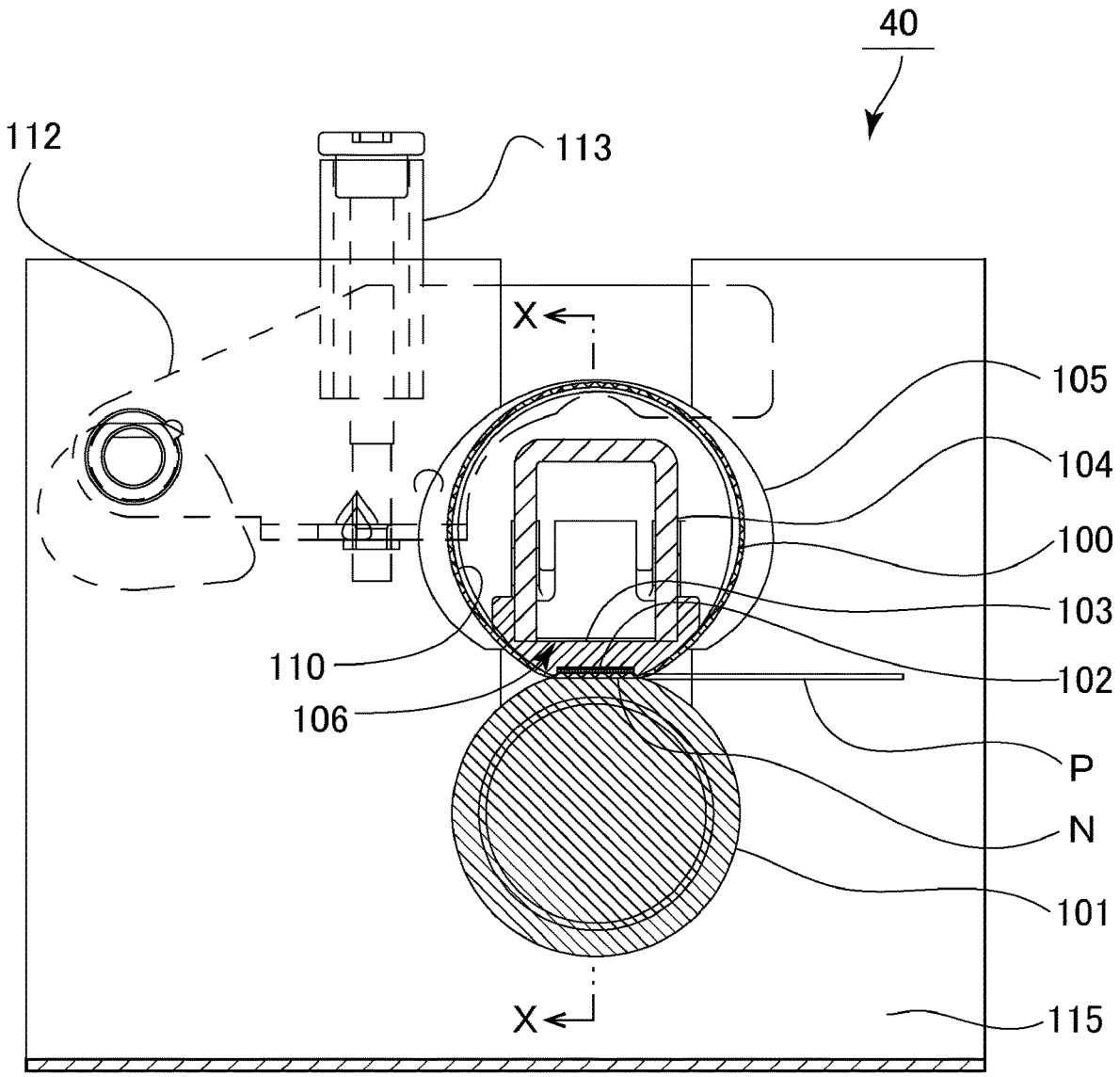
FIG. 2 is a schematic sectional view of a fixing device in the first embodiment of the present invention; it shows the general structure of the fixing device.

Next, referring to FIGS. 2-5, the fixing device 40 is described in detail. Referring to FIG. 2, the fixing device 40 has: a fixation belt 100, which is an example of an endless belt; a pressure roller 101 which is an example of a rotational member; and a belt-backing member 106. The fixation belt 100 is a thin endless belt. It is held by a pressing member 103, which is a part of the belt-backing member 106, by its inward surface. It can be removably fitted around a combination of the belt-backing portion 106, a belt frame 104, and a belt guide 105, which will be described later, so that it can be replaced as it reaches the end of its life span.

The pressure roller 101 is provided with an elastic layer. It is pressed against the pressing member 103 so that its peripheral surface remains in contact with the peripheral surface of the fixation belt 100, which remains pressed toward the pressure roller 101 by the pressing member 103 as will be described later. Further, the pressure roller 101 rotates in contact with the outward surface of the fixation belt 100, causing thereby fixation belt 100 to be rotated by the rotation of the pressure roller 101.

Figure 3:
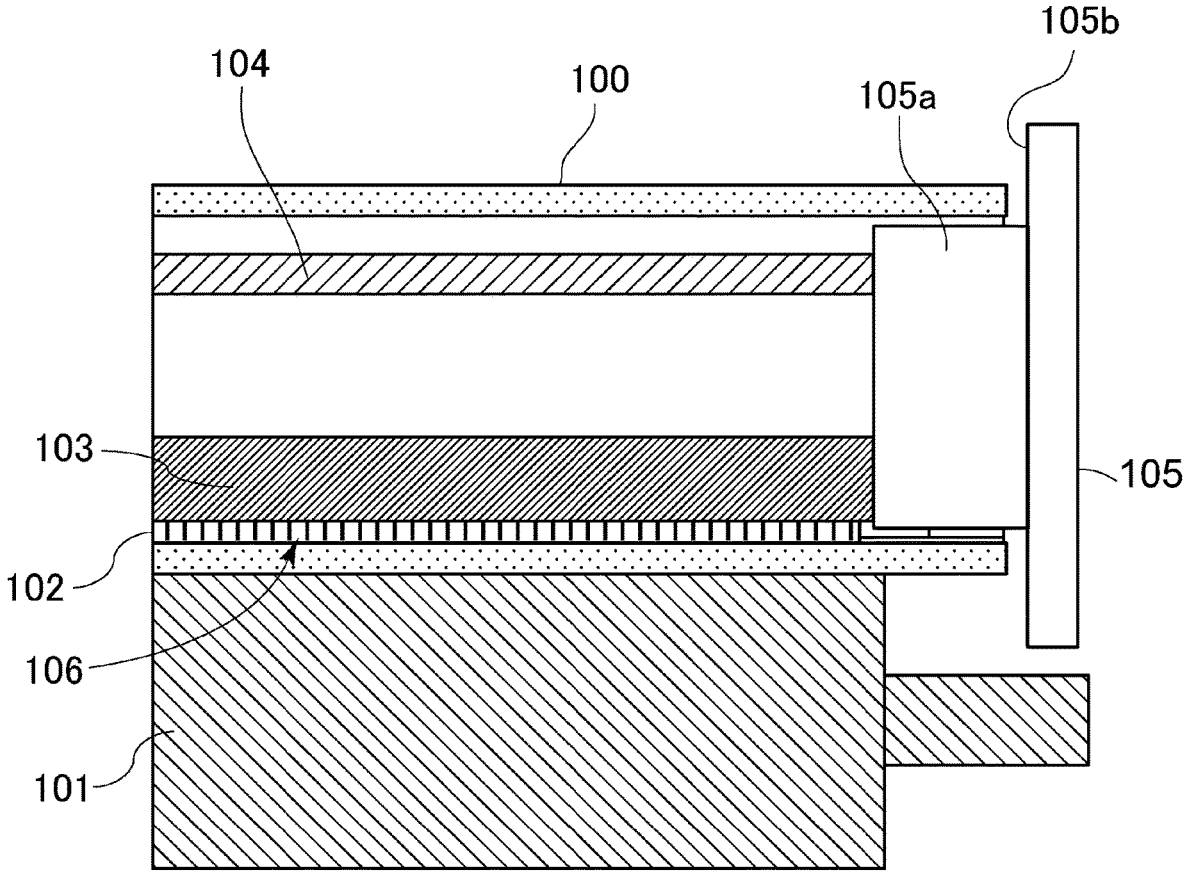
FIG. 3 is a schematic sectional view of the fixing device in the first embodiment, at a plane X-X in FIG. 2.

Referring to FIG. 3, the fixing device 40 is provided with the belt frame 104, which looks like a beam. The belt frame 104 is positioned so that it extends through the hollow of the fixation belt 100 in the direction parallel to the widthwise direction of the fixation belt 100 (lengthwise direction of fixation belt 100; rotational axis of fixation belt 100; left-right direction of FIG. 3). The lengthwise ends of the belt frame 104 are fitted with a pair of belt guides 105, one for one.

Not only does the belt guide 105 guide the fixation belt 100 by the corresponding edge of the fixation belt 100 as the fixation belt 100 circularly moves, but also, regulates the fixation belt 100 in position in terms of the direction parallel to the widthwise direction of the fixation belt 100. The belt guide 105 has: a cylindrical guiding portion 105*a*; and a flange-like regulating portion 105*b* which is attached to the outward end of the guiding portion 105*a*. The belt guide 105 is positioned so that its guiding portion 105*a* fits within the corresponding widthwise end portion of the fixation belt 100 to support the fixation belt 100 from within the fixation belt 100 while the fixation belt 100 is rotated. The regulating portion 105*b* regulates the movement of the fixation belt 100 in the widthwise direction of the fixation belt 100 by being positioned so that as the fixation belt 100 deviates in position in its widthwise direction, the corresponding end of the fixation belt 100 comes into contact with the regulating portion 105*b*.

Figure 4:
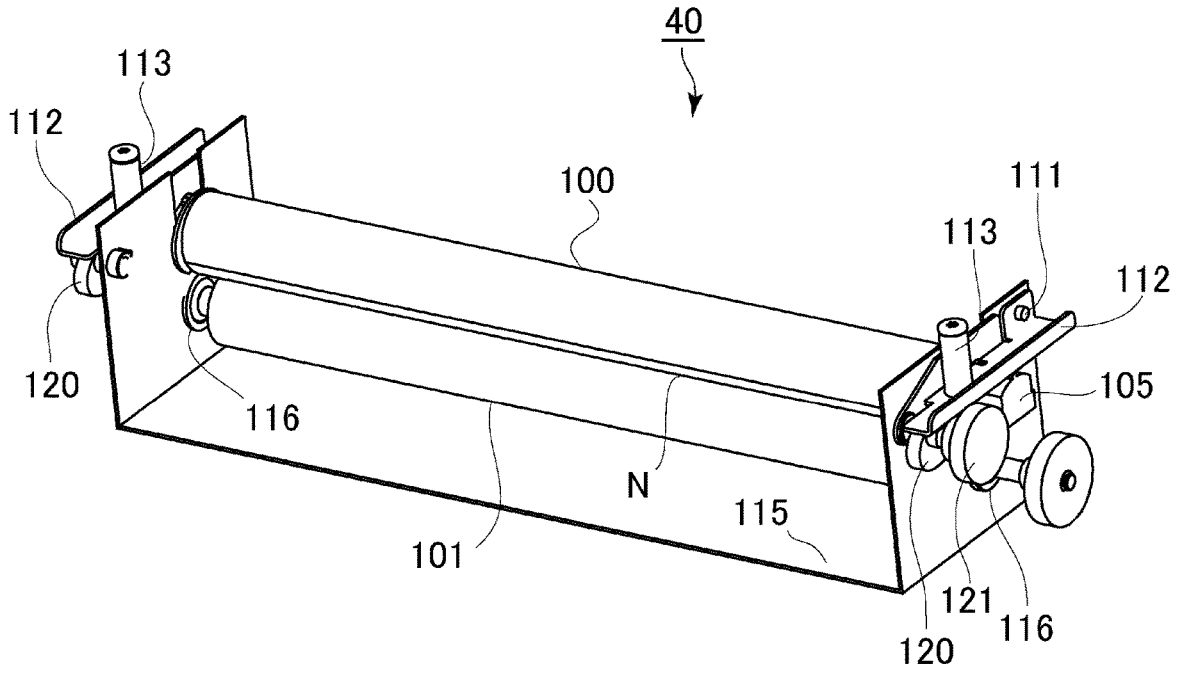
FIG. 4 is a schematic perspective view of the fixing device in the first embodiment.

Next, referring to FIG. 4, the pressure roller 101 is rotatably supported by a pair of bearings 116 fixed to a fixation frame 115. The pair of belt guides 105, which are at the lengthwise ends of the fixation belt 100, one for one, are under the pressure generated toward the pressure roller 101 by a pair of compression springs 113, with the presence of a pair of pressure application levers 112, one for one, between the compression springs 113 and pressure roller 101.

Each pressure application lever 112 is supported by the corresponding end of the fixation frame 115 in terms of the widthwise direction, in such a manner that it can be pivotally moved about a pivot 111. The opposite end of the pressure application lever 112 remains under the downward pressure generated by the compression spring 113. The pair of belt guides 105 which are under the pressure from the pair of pressure application levers 112 cause the outward surface of the fixation belt 100 to be pressed upon the peripheral surface of the pressure roller 101, with the presence of the belt frame 104, and the belt-backing portion 106 (FIGS. 2 and 3), which will be described later, between the pair of belt guides 105 and the pair of pressure application levers 112. Thus, a heating nip N for heating a sheet P of recording medium is formed between the fixation belt 100 and pressure roller 101.

While the fixing device 40 is in operation, the pressure roller 101 is rotationally driven by an unshown fixing device driving portion such as a motor. As the pressure roller 101 is rotated, the fixation belt 100 is rotated by the pressure roller 101.

As a pair of cams 120, which are manually rotatable by way of a gear 121, are rotated, the pressure application lever 112 pivotally move about the pivots 111. As the opposite end of the pressure application lever 112 from the pivot 111 is pushed up, the fixation belt 100 separates from the pressure roller 101, and therefore, the heating nip N disappears. If the fixing device 40 becomes jammed by a sheet P of recording medium, which got stuck in the heating nip N between the fixation belt 100 and pressure roller 101 during its operation, the sheet P can be easily removed from the heating nip N by operating the aforementioned mechanism for separating the fixation belt 100 from the pressure roller 101.

The fixation belt 100 is removably fitted around the belt-backing portion 106, which is stationarily attached to the fixation frame 115 after the fitting of the fixation belt 100 around the belt-backing portion 106. As the belt-backing portion 106 is moved downward by the pressure from the pair of compression springs 113, the belt-backing portion 106 causes the outward surface of the fixation belt 100 to press on the peripheral surface of the pressure roller 101, forming thereby the nip N for heating a sheet P of recording medium, between the fixation belt 100 and pressure roller 101.

The belt-backing portion 106 has: the pressing member 103 for pressing the fixation belt 100 toward the pressure roller 101; and a heating member attached to the pressing member 103 to heat a sheet P of recording medium as the sheet P is moved through the heating nip N. More concretely, the downwardly facing surface portion (heating nip N side) of the belt-backing portion 106 is provided with a long and narrow groove, which extends in the lengthwise direction of the pressing member 103 (widthwise direction of fixation belt 100), and in which a heating member 102 is disposed. The heating member 102 is a flat heating element (exothermic resistor). It heats the image bearing surface of a sheet P of recording medium, through the fixation belt 100.

As described above, the pressing member 103, which is a part of the belt-backing portion 106, remains under the pressure which is generated by the pair of compression springs 113 in the direction to press the pressing member 103 toward the pressure roller 101 through the combination of the pressure application lever 112, belt guide 105, and belt frame 104. Thus, the pressing member 103 remains under the reactive pressure which is generated by the pressure roller 101 in the direction to cause the pressing member 103 to bow. However, there is the belt frame 104 on the opposite side of the pressing member 103 from the heating nip N. Therefore, the pressing member 103 remains straight in spite of the presence of the pressure from the pair of compression springs 113, which acts in a manner to cause the pressing member 103 to bow.

Referring to FIG. 2, the fixing device 40 structured as described above gives thermal energy to a sheet P of recording medium from its heating member 102, in the heating nip N, while the sheet P is conveyed through the heating nip N, remaining pinched between the fixation belt 100 and pressure roller 101. Further, while the sheet P is conveyed through the fixation nip N, the sheet P is pressed between the fixation belt 100 and pressure roller 101. Consequently, the unfixed toner image on the sheet P melts, and becomes fixed to the sheet P as it cools down. After being conveyed through the fixation nip N, the sheet P is separated from the fixation belt 100, and is discharged from the image forming apparatus 1.

Next, the fixation belt 100, pressure roller 101, and heating member 102 are described in detail. To begin with, referring to FIG. 5, the fixation belt 100 employed by the fixing device 40, has: an endless substrative. layer 100*a*; and a release layer 100*b* formed on the outward surface of the substrative layer 100*a*. Further, the inward surface of the substrative layer 100*a* is coated with lubricant 110.

From the standpoint of reducing the fixing device 40 in the length of time it takes for the fixing device 40 to start up, the substrative layer 100*a* is desired to be as small as possible in thermal capacity. Thus, the material for the substrative layer 100*a* is desired to be such heat resistant resin as polyimide and PEEK, which is no more than 100 μm, preferably, no more than 60 μm and no less than 20 μm, in thickness. The release layer 100*b*, which is on the surface (outward surface) of the substrative layer 100*a*, which comes into contact with a sheet P of recording medium, is a coated layer, or a sheet, of a substance, to which toner is unlikely to adhere. In this embodiment, the substrative layer 100*a* is formed of polyimide. It is 50 μm in thickness. Further, the fixation belt 100 is 30 mm in internal diameter. The release layer 100*b* is formed of fluorine resin, more specifically, PFA (copolymer of tetrafluoroethylene and perfluoroalkylvinylether). It is 10 μm in thickness. However, the fixation belt 100 may be such an endless belt made up of a substrative layer formed of highly heat resistant resin such as polyether, polyethyleneterephthalate, polyimide, an electrically conductive layer formed on the substrative layer, and a release layer formed on the electrically conductive layer.

The pressure roller 101 is made up of a cylindrical metallic core formed of such metallic substance as iron and aluminum, an elastic layer formed of sponge, silicon rubber, or the like, on the peripheral surface of the metallic core, and a release layer formed on the outward surface of the elastic layer to make it unlikely for toner to remain adhered to the pressure roller 101. In this embodiment, the metallic core is made of soft iron. After the surface of the metallic core is blasted to roughen it, the metallic core is washed clean. Then, the metallic core is inserted in a cylindrical mold. Then, liquid silicon rubber is poured into the cylindrical mold, and is thermally hardened. By the way, in order to form the release layer as the surface layer of the pressure roller 101, a piece of tube formed of PFA resin coated with adhesive on the inward side is inserted in the mold, prior to the pouring of the liquid silicon rubber into the cylindrical mold. Thus, as the silicon rubber is thermally hardened, the piece of tube becomes adhered to the elastic layer. After the pressure roller 101 is formed through the process described above, it is subjected to the secondary vulcanization process to be adjusted in hardness. As for the secondary vulcanization process, the pressure roller 101 is heated by an oven for a certain length of time. After the formation of the pressure roller 101 through the process described above, the pressure roller 101 in this embodiment is such that it is 30 mm in external diameter, roughly 22 mm in the thickness of its elastic layer, and 50 μm in the thickness of its release layer.

The heating member 102 is a ceramic heater. This heating member 102 is made up of a long, narrow, and thin substrate, a heat generating member, and a glass coat. The substrate is formed of AlN, which is excellent in thermal conductivity. The heat generating member is formed by applying Ag/Pd paste to the MN substrate through a printing process, and sintering the paste. The glass coat is formed, as a friction reducing member, on the heat generating member to a thickness of roughly 50-60 μm. On the opposite surface of the AlN substrate from the heating member 102, there is provided a thermistor, which is disposed so that it is kept pressed upon the substrate by an unshown pressing member such as a spring by a preset amount of pressure (unshown).

[Application of Lubricant]

As described above, the heating member 102 and pressing member 103, which are parts of the belt-backing portion 106, are rubbed by the inward surface of the fixation belt 100. That is, referring to FIGS. 2 and 5, the fixation belt 100 is endless. It rubs the pressing member 103 and heating member 102, which are stationary, by its inward surface while remaining under the pressure from the pair of springs. Further, the pressing member 103 and heating member 102 are positioned so that they extend in the direction which is perpendicular to the widthwise direction of the fixation belt 100, which is perpendicular to the rotational direction of the fixation belt 100. Thus, the area of contact between the inward surface of the fixation belt 100, and the pressing member 103, and that between the inward surface of the fixation belt 100, and the heating member 102, also extend in the direction parallel to the widthwise direction of the fixation belt 100.

In this embodiment, therefore, the inward surface of the fixation belt 100 is coated with lubricant 110 in advance, in order to minimize the fixing device 40 in the amount of friction between the pressing member 103 and the inward surface of the fixation belt 100, and that between the heating member 102 and the inward surface of the fixation belt 100. Next, referring to FIGS. 2, and 5-7, how this lubricant 110 is applied is described.

Figure 5:
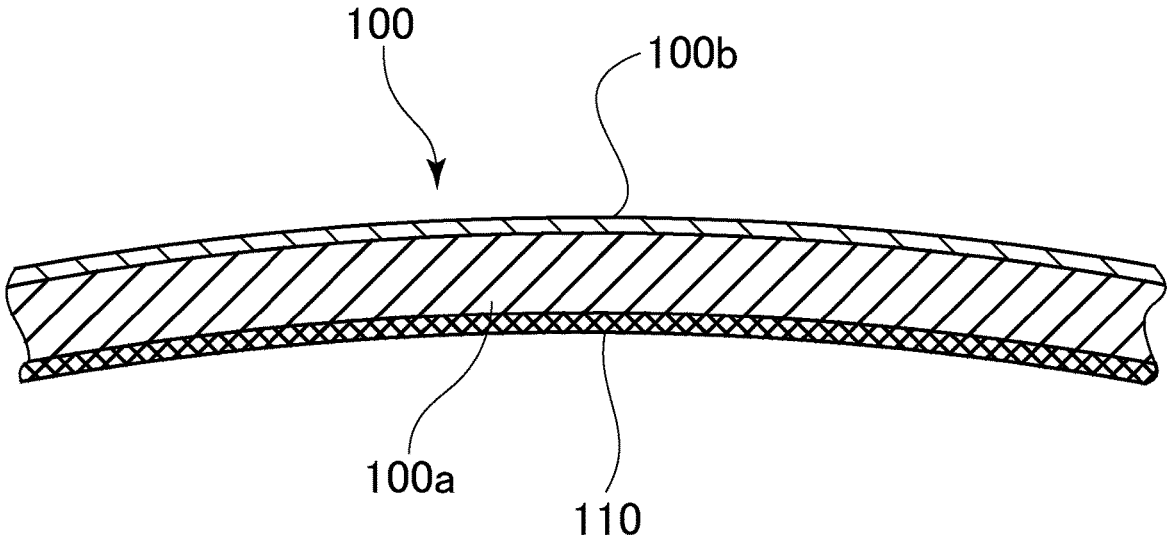
FIG. 5 is a schematic sectional view of a part of a fixation belt in the first embodiment, at a plane which is perpendicular to the fixation belt.

Referring to FIG. 5, in this embodiment, the inward surface of the substrative layer 100*a* of the fixation belt 100 is coated with the lubricant 110 (heat resistant grease) in advance, that is, before the fixation belt 100 is fitted around the combination of the belt-backing portion 106 and belt frame 104. For example, the inward surface of the fixation belt 100 is coated with the lubricant 110, in a factory. After the coating of the fixation belt 100 with the lubricant 110, the fixation belt 100 is packaged for shipment, and then, is shipped out of the factory.

In particular, in this embodiment, as shown in part (a) of FIGS. 7 and 7(*b*), virtually the entirety of the inward surface of the substrative layer 100*a* of the fixation belt 100 is coated with the lubricant 110, except for the preset widthwise end portions A and B, in terms of the widthwise direction of the fixation belt 100, which extend inward of the fixation belt 100 from the edges of the fixation belt 100, by a preset distance. In this embodiment, a mixture of perfluoropolyether, as a base, and PTFE (polytetra-fluoroethylene, as a conditioning additive, is used as the lubricant 110.

The process for producing the fixation belt 100 is as follows: First, resinous liquid is applied to a cylindrical mold, and is dried to form a cylindrical hollow belt of resin, as the substrative layer 100*a* (FIG. 5). Then, the outward surface of this hollow cylindrical belt of resin, or the substrative layer 100*a* of the fixation belt 100, is coated with liquid fluorine resin by dipping, spraying, or the like method to form the release layer 100*b* (FIG. 5).

After the formation of the release layer 100*b* on the outward surface of the substrative layer 100*a*, the fixation belt 100 is removed from the cylindrical mold. Then, the inward surface of the fixation belt 100 is coated with the lubricant 110 with the use of a lubricant applying apparatus 80, as shown in part (a) of FIGS. 6 and 6(*b*).

The lubricant applying apparatus 80 has: a pair of belt supporting rollers 81, and a dispenser 82 which has a nozzle 83. The fixation belt 100 is supported by the pair of belt supporting rollers 81, and is rotated in the direction indicated by an arrow mark in part (a) of FIG. 6, at a preset speed. The nozzle 83 is positioned in parallel to the fixation belt 100, and is inserted into the hollow of the fixation belt 100. Then, the nozzle 83 is slid in the directions indicated by an arrow mark R4 at a preset speed, releasing the lubricant 110 from its tip by a preset amount, while the fixation belt 100 is rotated. Since the nozzle 83 is slid at a preset speed while the fixation belt 100 is rotated at a preset speed, the lubricant 110 is roughly uniformly applied to the inward surface of the fixation belt 100 in terms of both the widthwise and circumferential directions of the fixation belt 100.

The positioning of the nozzle 83 by a combination of a ball screw and a motor is synchronized with the timing with which the lubricant 110 is ejected by the ejection pump of the dispenser 82. The amount by which the lubricant 110 is applied is controlled by the shape of the tip of the nozzle 83. It is also controlled based on the value indicated by a sensor for detecting the amount of the heat resistant grease flow. Thus, it is possible to coat the inward surface of the fixation belt 100 with the lubricant 110 to a preset thickness. Further, the lengthwise end portions A and B of the fixation belt 100, which extend inward of the fixation belt 100 by a preset length, in parallel to the axial line of the fixation belt 100, are not to be coated with the lubricant 110. Therefore, while the nozzle 83 is slid across these widthwise end portions A and B, the ejection pump of the dispenser 82 is controlled so that the value indicated by the flow sensor is zero.

As a result, the preset widthwise end portions A and B of the inward surface of the fixation belt 100, which extend inward of the fixation belt 100 in the direction parallel to the axial line of the fixation belt 100 by a preset distance, are not coated with the lubricant 110, and the rest of the inward surface of the fixation belt 100 (entirety of inward surface minus portions A and B) are coated with the lubricant 110 to a thickness of C, as shown in part (a) of FIGS. 7 and 7(*b*).

In this embodiment, the lubricant applying apparatus 80 is controlled so that the dimension of the lubricant free portions A and B in terms of the widthwise direction of the fixation belt 100 becomes 3 mm, and the layer of the lubricant 110 becomes 20 μm-30 μm (no less than 20 μm and no more than 30 μm) in thickness C. Regarding the thickness C to which the lubricant 110 is to be applied, as long as it is no less than 5 μm, it does not occur that the fixation belt 100 becomes unusable before it reaches the end of its expected life span (150,000 sheets of ordinary paper of size A4).

In the case of this embodiment, even through the fixing device 40 is structured so that the inward surface of the fixation belt 100 is to be coated with the lubricant 110 prior to the installation of the fixation belt 100 into the fixing device 40, the lubricant 110 is unlikely to transfer onto the outward surface of the fixation belt 100. That is, it is designed so that the widthwise end portions of the inward surface of the fixation belt 100, in terms of the widthwise direction of the fixation belt 100, are not coated with the lubricant 110. Therefore, it is unlikely for the packaging material for the fixation belt 100 to come into contact with the lubricant 110 on the inward surface of the fixation belt 100, during the shipment of the packaged fixation belt 100, from the factory to its destination. Therefore, it is unlikely to occur that the lubricant 110 on the inward surface of the fixation belt 100 transfers onto the packing material, and then, to the outward surface of the fixation belt 100.

At this time, the process for replacing the fixation belt 100 in the fixing device 40 is described.

First, the belt unit which comprises the used fixation belt 100, belt guides 105, belt-backing portion 106, belt frame 104, etc., is removed from the fixing device 40. Then, one of the belt guides 105 is to be removed from the removed belt unit. Then, the fixation belt 100 is to be slid away from the belt-backing portion 106 in the lengthwise direction of the belt-backing portion 106. Then, a brand-new fixation belt 100 in the fixation belt package is moved out of the package. Then, the brand-new fixation belt 100 is to be fitted around the belt-backing portion 106 by being slid along the belt-backing portion 106 in the lengthwise direction of the belt-backing portion 106. Then, the removed belt guide 105 is to be reattached. Then, the belt unit is to be attached to the fixing device 40. The inward surface of the brand-new fixation belt 100 from the fixation belt package has been coated with the lubricant 110 in advance, and therefore, does not need to be coated with the lubricant 110. Therefore, it is very simple to replace the used belt 100.

Further, this embodiment can prevent the problem that during the process of fitting the brand-new fixation belt 100 around the combination of the belt-backing portion 106 and belt frame 104 while replacing the used fixation belt 100, the lubricant 110 transfers onto the hands of an operator, and then, to the outward surface of the fixation belt 100. Further, it can prevent the problem that finger prints are placed on the outward surface of the brand-new fixation belt 100 during the replacement of the used fixation belt 100. Therefore, this embodiment can prevent the problem that the image forming apparatus 1 outputs defective images due to the adhesion of the lubricant 110 to the fixation belt 100.

Further, a brand-new fixation belt 100 which is for replacing the used fixation belt 100 in the fixing device 40 has been coated in advance with the lubricant 110. Therefore, it is unnecessary for an operator to coat the inward surface of the brand-new fixation belt 100 with the lubricant 110 when the operator carries out a maintenance operation. In other words, not only can this embodiment improve the fixing device 40 in the efficiency with which the fixing device 40 can be maintained, but also, it can eliminate the problem attributable to the mistake that the operator forgets to coat the inward surface of the fixation belt 100 with the lubricant 110 after the replacement of the used fixation belt 100. Moreover, coating the inward surface of a brand-new fixation belt 100 with the lubricant 110 in a factory ensures that the inward surface is coated with the lubricant 110, making it possible to minimize the fixation belt 100 in the nonuniformity in temperature, which is attributable to the nonuniformity in the thickness of the lubricant layer, which occurs after the application of the lubricant 110.

By the way, in this embodiment, the widthwise end portions A and B of the inward surface of the fixation belt 100, which are not coated with the lubricant 110, are created by controlling the dispenser 82 in the index of its flow sensor. However, the widthwise end portions A and B of the inward surface of the fixation belt 100, which are not coated with the lubricant 110, may be created by masking the portions of the inward surface of the fixation belt 100, which correspond to the widthwise end portions A and B.

Further, in this embodiment, both of the preset widthwise end portions A and B of the inward surface of the fixation belt 100 are not coated with the lubricant 110. However, it may be only one of the aforementioned widthwise end portions A and B that is not coated with the lubricant 110. That is, all that is necessary is that when the inward surface of the fixation belt 100 is coated with the lubricant 110, at least one of the widthwise end portions of the inward surface of the fixation belt 100, which extend inward of the fixation belt 100 from the edges of the fixation belt 100 by a preset distance, is left uncoated.

Embodiment 2

Next, referring to parts (a) and (b) of FIG. 8, the second embodiment of the present invention is described. In the first embodiment described above, the widthwise end portions A and B of the inward surface of the fixation belt 100 are not coated with the lubricant 110. In this embodiment, however, the widthwise end portions A and B of the inward surface of the fixation belt 100 are coated with a thinner layer of the lubricant 110 than the rest. That is, the amount by which the widthwise end portions A and B are coated with the lubricant 110 per unit area (amount of lubricant/size of coated portion) in this embodiment is less than in the first embodiment. Otherwise, the fixing device 40 in this embodiment is the same in structure and function as the one in the first embodiment. Thus, the components of the fixing device 40 in this embodiment, which are the same in structure and function as the counterparts in the first embodiment are given the same referential codes as those given to the counterparts, and are not described, or only briefly described. Hereafter, the second embodiment is described regarding primarily the portions of the fixing device 40 in this embodiment, which are different from the counterparts in the first embodiment.

Referring to FIG. 3 which was referred to for the description of the first embodiment, the belt guides 105 for guiding the fixation belt 100 by the widthwise edges of the fixation belt 100, are rubbed by the outward edges of the fixation belt 100 in terms of the widthwise direction of the fixation belt 100. If neither of the widthwise end portions A and B is not coated with the lubricant 110 as in the case of the first embodiment, it is possible that the portion of each belt guide 105, which comes into contact with the fixation belt 100, and the portions of the fixation belt 100, which come into contact with the belt guide 105, will suffer from frictional wear. If the belt guides 105 continue to be frictionally worn, it is possible that the particles which result from the frictional wear of the belt guide 105, will mix into the lubricant 110. If these particles mix into the lubricant 110, it is possible that the lubricant 110 will reduce in lubricity, making it possible that the fixation belt 100 will slip, which in turn will cause the image forming apparatus 1 to output unsatisfactory images, and/or will cause the fixing device 40 to generate strange noises as the fixation belt 100 slips and sticks.

In this embodiment, therefore, the preset widthwise end portions A and B of the inward surface of the fixation belt 100 are coated with the lubricants 110*a* and 110*b*, to thicknesses of D and E, respectively, whereas the rest of the inward surface of the fixation belt 100 is coated with the lubricant 110 to a thickness of C. By the way, the inward surface of the fixation belt 100 is coated with lubricant so that the thicknesses D and E of the lubricants 110*a* and 110*b*, respectively, are less than the thickness C of the lubricant 110.

That is, in this embodiment, the entirety of the inward surface of the substrative layer 100*a* (FIG. 5) of the fixation belt 100 is coated with the lubricants 110, 110*a*, and 110*b* in terms of the widthwise direction as well as the circumferential direction. However, the thicknesses D and E, to which the widthwise end portions A and B of the inward surface of the fixation belt 100 are coated with the lubricants 110*a* and 110*b*, respectively, are less than the thickness C to which the rest of the inward surface of the fixation belt 100 is coated with the lubricant 110.

In this embodiment, the lubricant applying apparatus 80 (parts (a) and (b) of FIG. 6) is controlled in the index value of its flow sensor so that, in terms of the widthwise direction of the fixation belt 100, the dimension of each of the widthwise end portions A and B becomes 3 mm, and also, so that the thickness C of the lubricant 110 becomes 20 μm-30 μm, and the thicknesses D and E of the lubricants 110*a* and 110*b*, respectively, become 3 μm. The thickness C of the lubricant 110 has only to be no less than 5 μm. As long as the thickness C is no less than 5 μm, it does not occur that the fixation belt 100 prematurely wears out relative to its life expectancy (150,000 sheets of ordinary paper of type A4). By the way, in terms of the widthwise direction of the fixation belt 100, the widthwise end portions A and B are desired to be no less than 3 mm and no more than 20 mm in dimension.

Further, the thicknesses D and E to which the widthwise end portions A and B of the inward surface of the fixation belt 100 are coated with the lubricants 110*a* and 110*b*, respectively, are desired to be no less than 0 μm and no more than 5 μm. As long as the thicknesses D and E are no more than 5 μm, that is, as long as the lubricants 110*a* and 110*b* are extremely thin, even if the belt edges come into contact with the packaging material, the lubricants 110*a* and 110*b* are unlikely to transfer onto the packaging material, and therefore, it is unlikely to occur that the adhesion of the lubricant to the outward surface of the fixation belt 100 causes the image forming apparatus 1 to output unsatisfactory images.

Moreover, in this embodiment, the preset widthwise end portions A and B of the fixation belt 100 are coated with the lubricants 110*a* and 110*b*, respectively, to reduce the fixing device 40 in the amount of the frictional resistance between the belt guide 105 and fixation belt 100. Therefore, the fixing device 40 is minimized in the amount of the frictional wear of the belt guide 105 and fixation belt 100. Therefore, it is possible to prevent the problem that the lubricant 110 is reduced in lubricity by the particles which result from the frictional wear of the belt guide 105 and fixation belt 100 and mix into the lubricant 110. Therefore, it is possible to prevent the problem that the image forming apparatus 1 is caused to output unsatisfactory images, by the slipping of the fixation belt 100, and/or strange noises are generated by the slipping-and-sticking of the fixation belt 100.

In this embodiment, the preset widthwise end portions A and B of the inward surface of the fixation belt 100 are coated with lubricants 110*a* and 110*b*, to the thicknesses D and E, respectively, which are less than the thickness C. However, it may be only one of the preset widthwise end portions A and B that is coated with lubricant to a thickness which is less than the thickness C. That is, all that is necessary is that the thickness to which one of the first and second preset widthwise end portions of the inward surface of the fixation belt 100 is coated with lubricant is less than the thickness to which the second preset widthwise end portions is coated, and the thickness to which the rest is coated with lubricant. In such a case, the second preset portion does not need to be coated with lubricant, or may be coated the same thickness as the thickness C. Moreover, the second preset widthwise end portion may be coated with lubricant to a thickness which is less than the thickness C, but, is more than the thickness to which the first preset portion is coated with lubricant.

For example, the inward surface of the fixation belt 100 may be coated with lubricant in such a manner that the thickness D to which the preset widthwise end portion A (first preset portion) of the fixation belt 100 is coated with lubricant becomes less than the thickness C to which the portion of the inward surface of the fixation belt 100 other than the widthwise end portions A and B are coated with lubricant, and the widthwise end portion B (second preset portion) is not coated with lubricant. Also in this case, the thickness C is desired to be no less than 5 μm, and the thickness D is desired to be no less than 0 μm and no more than 5 μm.

Further, the inward surface of the fixation belt 100 may be coated with the lubricant 110 in such a manner that the thickness D to which the widthwise end portion A (first preset portion) is coated with the lubricant 110 is less than the thickness C to which the portion of the inward surface of the fixation belt 100 other than the widthwise end portions A and B is coated with the lubricant, and thickness E to which the widthwise end portion B (second preset portion) is coated with lubricant becomes less than the thickness C, but, is more than the thickness D. Also in this case, the thickness E is desired to be no less than 0 μm, and no more than 5 μm. However, as long as the thickness E is less than the thickness C, it may be no less than 5 μm. Also in this case, however, the thickness E is desired to be no more than 10 μm.

<Miscellanies>

In each of the preceding embodiments, the lubricant 110 was applied to the entirety of the inward surface of the fixation belt 100 in terms of both the widthwise and circumferential directions. However, effects which are similar to those obtained by the fixing devices 40 in the preceding embodiments are also obtainable by a fixing device structured so that at least portions 200 of the inward surface of its fixation belt, in terms of the circumferential direction of the fixation belt, are not coated with lubricant as shown in part (a) of FIG. 9. In other words, it may be only a part of the inward surface of the fixation belt, in terms of the circumferential direction of the fixation belt, as shown in part (a) of FIG. 9, that is coated with lubricant. Also in this case, the inward surface of the fixation belt is coated with the lubricant 110, except for at least one of the widthwise end portions A and B, as shown in part (b) of FIG. 9. The fixation belt 100 shown in part (a) of FIGS. 9 and 9(*b*) are the same as the one in the first embodiment, except that the portions 200 of the inward surface of the fixation belt 100 in terms of the circumferential direction of the fixation belt 100, shown in part (a) of FIGS. 9 and 9(*b*), are not coated with the lubricant 110.

Further, the inward surface of the fixation belt 100 may be coated in such a manner that the portions 200, in terms of the circumferential direction of the fixation belt 100, are not coated with lubricant, and a thickness to which at least one of the widthwise end portions A and B is coated with lubricant becomes less than the thickness to which the portions of the inward surface of the fixation belt 100 other than the widthwise end portions A and B is coated with the lubricant 110. Further, of the widthwise end portions A and B, one of them does not need to be coated with lubricant. In essence, even if the inward surface of the fixation belt 100 is coated so that the portions 200 in terms of the circumferential direction of the fixation belt 100 are not covered with lubricant, the pattern, in terms of the widthwise direction of the fixation belt 100, in which the inward surface of the fixation belt 100 is coated with lubricant may be the same as that in the first and second embodiments.

In the foregoing description of the embodiments of the present invention, it was assumed that the fixation belt 100 is a replacement fixation belt. The present invention, however, is also applicable to a fixation belt which is to be initially installed in a fixing device during the assembly of a fixing device.

Further, in the case of each of the fixing devices 40 in the preceding embodiments described above was such a fixing device that the image heating side of the fixing device was equipped with an endless belt. However, the application of the present invention is not limited to fixing devices of this type. For example, the present invention is also compatible with fixing devices of such a type that the endless belt coated with lubricant on its inward surface as described above is a part of the pressing side of the fixing device, that is, the opposite side of the fixing device from the heating side. Moreover, a rotational member which forms a heating nip by being pressed upon a fixation belt does not need to be limited to a roller. It may be an endless belt. In such a case, both endless belts are coated with lubricant on their inward surface as described above.

Further, the heat source for a fixing device to be mounted in an image forming apparatus may be a heater based on electromagnetic induction, a heat lamp, or a flat heat generating resistor. That is, the method for heating a heating nip does not need to be limited to a method which uses a heat generating resistor. That is, it may be a heating method that uses a radiant heat source, an inductive heat source, a gas-based heat source, a heat pipe, or the like. A fixing device to which the present invention is applicable includes a heating device for adjusting an image in surface properties such as glossiness.

Further, compatibility of the present invention is not limited to a full-color image forming apparatus. That is, not only is the present invention is compatible to a full-color image forming apparatus, but also, a monochromatic image forming apparatus. Further, not only is the present invention compatible with such image forming apparatuses as the one described in the foregoing, but also, various printing machines, facsimileing machines, copying machines, and multifunction machines which are capable of functioning as any one of the preceding machines.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-186878 filed on Oct. 1, 2018, which is hereby incorporated by reference herein in its entirety.

What is claimed is:

1. A replacement endless belt for an image heating device for heating an image on a recording material, said endless belt comprising:

an endless base layer;

a parting layer provided on an outer peripheral surface of said base layer; and a lubricant applied on at least a circumferentially partial area of an inner surface, except for predetermined regions from opposite ends of said endless belt.

2. The replacement endless belt according to claim 1, wherein said lubricant is applied on a circumferentially entire area of the inner surface, except for the predetermined regions.

3. The replacement endless belt according to claim 1, wherein each of said predetermined regions extends from an end to not less than 3 mm and not more than 20 mm away from the end.

4. A replacement endless belt for an image heating device for heating an image on a recording material, said endless belt comprising:

an endless base layer;

a parting layer provided on an outer peripheral surface of said base layer;

a first amount of lubricant per unit area applied on an inner surface in predetermined longitudinally partial regions from opposite ends of said endless belt; and a second amount of lubricant per unit area applied on the inner surface in a region inside the predetermined longitudinally partial regions, wherein the second amount is larger than the first amount.

5. The replacement endless belt according to claim 4, wherein said first and second amounts of the lubricant are applied on a circumferentially partial area.

6. The A-replacement endless belt according to claim 4, wherein said first and second amounts of the lubricant are applied on a circumferentially entire area.

7. The replacement endless belt according to claim 4, wherein each of said predetermined regions extends from an end to not less than 3 mm and not more than 20 mm away from the end.

8. A method of exchanging an endless belt provided in a belt unit for heating an image on a recording material, said belt unit including a slide portion on which an inner surface of said endless belt is slidable, said method comprising:

a first step of removing said endless belt from said belt unit; and a second step, after said first step, of mounting a replacement endless belt, said replacement endless belt including:

an endless base layer;

a parting layer provided on an outer peripheral surface of said base layer; and a lubricant applied on at least a circumferentially partial area of an inner surface of said base layer, except for predetermined regions from opposite ends of said replacement endless belt.

9. A method of exchanging an endless belt provided in a belt unit for heating an image on a recording material, said belt unit including a slide portion on which an inner surface of said endless belt is slidable, said method comprising:

a first step of removing said endless belt from said belt unit; and a second step, after said first step, of mounting a replacement endless belt, said replacement endless belt including:

an endless base layer;

a parting layer provided on an outer peripheral surface of said base layer;

a first amount of lubricant per unit area applied on an inner surface in predetermined longitudinally partial regions from opposite ends of said replacement endless belt; and a second amount of lubricant per unit area applied on the inner surface of said replacement endless belt in a region inside the predetermined longitudinally partial regions, wherein the second amount is larger than the first amount.

* * * * *